United States Patent [19]

Treadwell

[11] 4,266,773

[45] May 12, 1981

[54] GOLF BALL

[76] Inventor: William H. Treadwell, 140 Dunham Dr., Battle Creek, Mich. 49015

[21] Appl. No.: 80,126

[22] Filed: Sep. 27, 1979

[51] Int. Cl.[3] ..... A63B 37/14

[52] U.S. Cl. ..... 273/232; 40/327

[58] Field of Search ..... 273/232, 62, 235 R, 273/235 A, 235 B; 40/327

[56] References Cited

U.S. PATENT DOCUMENTS

| | | | |
|---|---|---|---|
| 2,135,210 | 11/1938 | Farrar | 273/232 |
| 3,819,190 | 6/1974 | Nepela et al. | 273/232 |

FOREIGN PATENT DOCUMENTS

| | | | |
|---|---|---|---|
| 16862 | of 1890 | United Kingdom | 273/232 |
| 4774 | of 1892 | United Kingdom | 273/232 |
| 2235 | of 1896 | United Kingdom | 273/232 |
| 904785 | 8/1962 | United Kingdom | 273/232 |

*Primary Examiner*—George J. Marlo

[57] ABSTRACT

A golf ball has alternating rough and smooth bands formed in its outer surface and the rough bands are aligned parallel to the ground when the ball is teed up. The rough bands are formed to completely trip the boundary layer of air flow around the ball in order to generate forces which counteract the forces generated by the smooth bands when the golf ball rotates about certain axes of rotation so as to control the path of the golf ball during its flight. The rough bands are formed in a plurality of spaced depressions in the outer surface of the golf ball.

7 Claims, 3 Drawing Figures

FIG-1
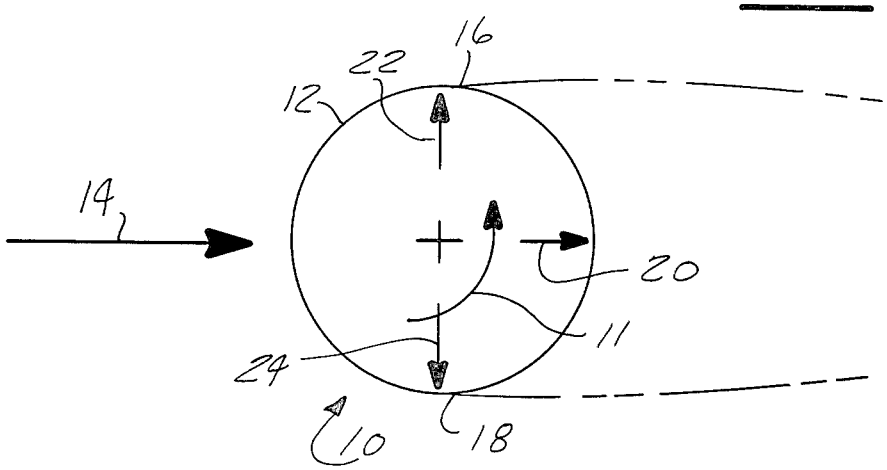
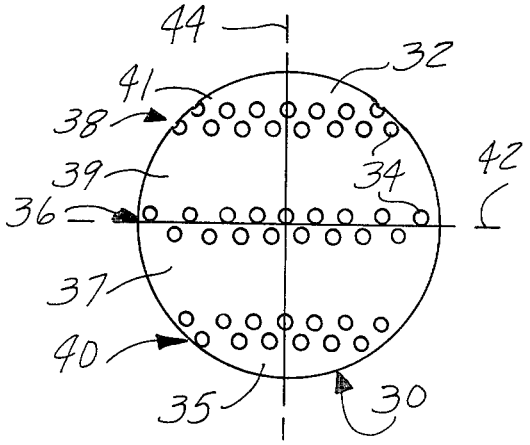
FIG-2
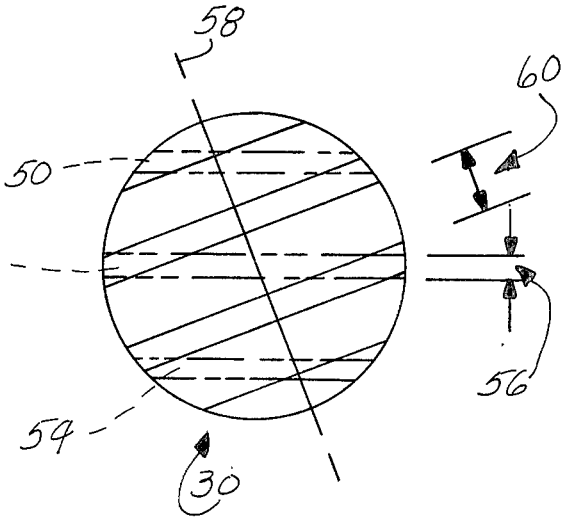
FIG-3

GOLF BALL

BACKGROUND OF THE INVENTION

1. Field of the Invention

This invention relates, in general, to golf balls and, more specifically, to surface configurations for golf balls.

2. Description of the Prior Art

The modern golf ball comprises a spherical body formed of a resilient material. The outer layer or surface of the ball is formed with a plurality of depressions or so-called "dimples" which act to provide superior aerodynamic properties when the ball is in flight.

When a golf club impacts with a conventional golf ball, the ball acquires translational velocity in the intended direction of travel and the ball spins about a rotational axis. The direction the axis of rotation assumes with respect to the ground and the amount of spin are the primary factors in determining how far the ball will travel and whether it will hook or slice, i.e., diverge from a straight path, upon leaving the golf club.

A wide variety of surface configurations for golf balls have been made in which the size, depth and disposition or pattern of the depressions on the surface of the ball have been varied in order to obtain optimum aerodynamic properties and improved flight performance. For example, the most widely used surface configuration on golf balls today has identical and uniformly spaced dimples over the entire surface of the ball. It is also known to provide certain dimple-free areas on the surface of the ball to achieve different flight characteristics, as shown in U.S. Pat. Nos. 3,819,190 and 4,142,727.

However, it has been discovered that yet improved flight characteristics can still be obtained over golf balls having these surface configurations. Despite the improved aerodynamic properties provided by these surface configurations in increasing the distance the ball travels, these dimple arrangements do little to correct or to control the flight path the ball takes when improperly hit, as commonly occurs with the average golfer. In hitting the ball, if the club is not traveling in the same direction as the intended path of the ball, i.e., with planar surface normal to the flight direction, a sideways spin is imparted to the ball causing forces to act thereon similar to those imparting lift to the ball during its flight. These sideways acting forces urge the ball to one side or the other from the intended flight path resulting in a curved flight, commonly referred to as a "hook" or "slice" depending upon the direction of the spin.

Thus, it would be desirable to provide a golf ball having an improved surface configuration which eliminates the forces acting on the golf ball during flight along certain axes of rotation. It would be desirable to provide a golf ball having an improved surface configuration in which the aerodynamic forces causing hooking or slicing of the ball during flight are substantially eliminated.

SUMMARY OF THE INVENTION

There is disclosed herein a golf ball having a new and improved surface configuration in which alternating rough and smooth bands are formed in the outer surface of the golf ball. The rough bands are formed to completely trip the boundary layer of air flow around the golf ball so as to generate forces which counteract the forces generated by the smooth bands when the golf ball rotates about certain axes of rotation and thereby control the path of the ball during its flight.

Preferably the rough bands comprise a plurality of spaced depressions in the outer surface of the golf ball. The rough bands of depressions are arranged in a parallel, spaced relationship on the outer surface of the golf ball.

In use, the ball is teed up such that the rough bands of depressions or dimples are disposed substantially parallel to the ground. When the ball is properly struck by a golf club, such that the ball rotates about an axis parallel to the plane of the rough bands of depressions, normal lift forces are developed. However, if the ball is improperly struck such that the golf club imparts a sideways spin to the ball, the ball will rotate on an axis perpendicular to the plane of the rough bands of depressions. This sideways spin would normally cause the ball to depart from a straight path, more commonly known as "hooking" or "slicing". However, the plurality of rough bands of depressions with corresponding smooth surfaces therebetween formed on the surface of the golf ball cause the forces generated when a sideways spin is imparted to the ball to be cancelled thereby eliminating any sideways motion which heretofore has caused a curved flight path.

It is also possible to form the rough bands of depressions so as to cause increased reverse forces when a sideways spin is imparted to the ball. The increased reverse forces function to eliminate the sideways acting forces when the ball is caused to rotate about an axis not precisely perpendicular to the plane of the rough bands of the depressions so as to correct for an open club face slice or closed club face hook that commonly occurs with an average golfer.

BRIEF DESCRIPTION OF THE DRAWINGS

The various features, advantages and other uses of this invention will become more apparent by referring to the following detailed description and drawing in which:

FIG. 1 is a pictorial representation of the forces acting upon a golf ball during flight;

FIG. 2 is a plan view of a golf ball having a surface configuration constructed according to the teachings of this invention; and FIG. 3 is a graphic representation of the effective width of the bands of depressions created when the golf ball is struck so as to rotate at an axis not precisely perpendicular to the plane of the bands of depressions.

DESCRIPTION OF THE PREFERRED EMBODIMENTS

Theoretical Background

Referring now to the drawing and to FIG. 1 in particular, there is shown a pictorial representation of the forces acting upon a golf ball 10 during flight. In order to provide a basic and more thorough understanding of the advantages and teachings of the golf ball constructed according to the features of this invention, the following discussion will relate to the golf ball 10 shown in FIG. 1 which has a substantially smooth outer surface 12.

As shown in FIG. 1, the golf ball 10 is rotating, as shown by arrow 11, in a fluid stream having a velocity acting upon the ball 10 in the direction of arrow 14. In addition, the surface 12 of the ball 10 is sufficiently smooth so as not to trip the boundary layer of the fluid stream flowing around the surface 12 of the ball 10. The ball 10 has a Reynolds number (Re) based on the sphere diameter that is close to the critical Re. In this case, the relative velocity between the sphere and the fluid on one side, indicated by reference number 16, can, for a range of rotational speeds of the sphere, result in a local Re>Re critical. This results in a turbulant boundary layer flow and the associated delayed separation point of the boundary layer. On the opposing side, indicated in general by reference number 18, the opposite is true. The relative velocity of the flow over the ball 10 results in a Re<Re critical and the boundary layer flow within this region is laminar flow. This results in early separation of the boundary layer. As a result of this type of flow pattern on the ball 10, the forces acting upon the ball 10 comprise a drag force, indicated generally by reference number 20, which is acting to the right in the orientation shown in FIG. 1, and an upward lift force indicated by reference number 22.

By comparison, the flow around a rotating sphere that has boundary layers that are turbulant over the entire sphere, such as that caused by a high Re or from a rough surface across the entire periphery of the sphere so as to trip the boundary layer, will be in a turbulant flow pattern on both sides of the sphere. Similarly, the flow around a sphere with a surface too smooth to trip the boundary layer and a Re much less than the Re critical will have completely laminar boundary layer flow. In both of these latter cases in which the boundary layer is of the same type over the entire surface of the sphere or ball 10, the lift component of the force, shown by reference number 24, acts in a downward direction for the given rotational direction. This downward acting force is commonly known as the Magnus force. In the situation where there are different types of boundary layers acting on the sphere, as described above, the lift component of the force acts in an upward direction. This can be called a reverse Magnus force or effect.

In view of the above, it is the purpose of this invention to provide a golf ball having a surface configuration which utilizes the reverse Magnus effect to cancel out the aerodynamic forces or Magnus forces acting on the sphere along certain axes of rotation.

The basic method is to provide rough surface areas at predetermined locations on a golf ball that will trip the boundary layer over that portion of the surface thus providing for a normal Magnus force in that area and leaving the remainder of the surface of the golf ball smooth to provide a reverse Magnus effect in those areas. In this manner, the selection of which axis or axes of rotation on which the cancellation of the aerodynamic forces will occur can be selectively chosen. The result is a cancellation of forces and no aerodynamic force for that axis of rotation of the golf ball. More practically, when a golf club impacts a golf ball of this invention in a manner which would commonly cause a hook or slice flight path, the sideways acting forces causing such a curved flight pattern are substantially eliminated or cancelled.

Functional Characteristics

Referring now to FIG. 2, there is shown a golf ball 30 having a surface configuration formed according to the teachings of this invention which incorporates the above-described reverse Magnus effect. The golf ball 30 may be formed in any conventional manner, such as with an inner core and an outer cover, or it can be molded into a single unitary member. In either type of construction, the golf ball 30 is provided with an outer surface, shown generally by reference number 32.

According to the teachings of this invention, the outer surface 32 of the golf ball 30 is provided with a plurality of spaced parallel alternating rough and smooth bands, 35,36,37,38, 39,40 and 41. The rough bands 36, 38 and 40 are formed to completely trip the boundary layer of air flow around the golf ball so as to cause turbulant boundary layer air flow. The rough bands 36, 38 and 40 may be formed in any surface configuration that will provide a sufficiently rough surface to completely trip the boundary layer flow. Thus, spherical depressions, grooves or ridges may be utilized, with spherical depressions or dimples being preferred. Preferably, three individual rough bands 36, 38 and 40 are utilized with one of the bands, band 36, being disposed on the circumferential centerline 42 of the ball 30 and the other bands 38 and 40 being equidistantly spaced therefrom on opposing sides of the band 36.

Although the depressions 34 are depicted and described as being formed in a spherical configuration, it will be understood the depressions may also be formed in other shapes, such as grooves or ridges. The only requirement for the shape of the depressions, or for that matter the surface of the rough bands, is that the surface within the band be rough enough to completely trip the boundary layer of fluid flow around the band.

Furthermore, in view of the above requirement, the density or spacing of the depressions within each band or the number of parallel bands on the golf ball may also be varied to provide different flight characteristics and performance.

When the golf ball 30, oriented as shown in FIG. 2, is impacted by a club in a proper manner so as to rotate in a downward direction, as viewed in FIG. 2, about an axis 42, the rough surface area formed by the plurality of spaced bands 36, 38 and 40 of depressions will completely trip the boundary layer of fluid flow around the entire peripheral surface of the ball 30 as the ball 30 spins or rotates about the axis of rotation 42. This causes normal lift forces to be developed. However, when the ball 30 is impacted by a golf club in an improper manner so as to impart sideways acting forces thereon which cause the ball 30 to rotate about axis 44 which is substantially perpendicular to the plane of the rough bands of depressions, the reverse Magnus forces provided by the smooth areas on the ball 30 will cancel the Magnus forces generated by the rough areas of depressions on the golf ball 30 so as to cancel out or eliminate sideways acting forces thereby preventing any departure of the golf ball 30 from its intended straight flight path.

In order to insure that the Magnus and reverse Magnus forces generated are equal so as to cancel out the resultant aerodynamic forces along a certain axes of rotation, the surface area on the ball 30 bounded by the depressions in each of the rough bands 36,38 and 40 should be approximately 1.2 times as large as the smooth surface area on the ball 30 due to the fact that the reverse Magnus force is approximately 0.8 times the Magnus force for a given rotation and freestream velocity. Thus, by making the rough surface area of the ball 30 larger than the smooth surface area, the cancellation of sideways acting aerodynamic forces imparted on the ball 30 can be assured.

Due to the use of a golf ball constructed according to the teaching of this invention by an average golfer, several additional considerations must be taken into account. It has been discovered that the rough surface provided by the bands of depressions will act to trip the boundary layer outside of the physical boundaries of the bands formed by the depressions to a small extent. In addition, it is unlikely that the average golfer will hit the ball in such a manner so as to cause the ball to rotate precisely about the axis 44 when he mishits a shot. If the axis of rotation is not substantially perpendicular to the plane of the bands of depressions, the effective size of the rough bands of depressions in tripping the boundary layer will increase, as shown in FIG. 3.

As seen therein, the ball 30 is formed identical to that shown in FIG. 2 and includes three spaced rough bands, the boundaries of which are indicated by reference numbers 50, 52, and 54. The rough bands of depressions have a width shown generally by reference number 56. However, when the ball 30 shown in FIG. 3 is hit so as to rotate about an axis 58 which is not perpendicular to the plane of the rough bands the effective width or size of the bands will increase, as shown by dimension 60.

In consideration of these factors, the rough surface on the ball 30 formed by the rough bands of depression may be made smaller than that required to exactly balance the Magnus and reverse Magnus forces so as to provide an excess of reverse Magnus force when the ball is rotated exactly about an axis perpendicular to the plane of the rough bands of depressions. This has the added advantage of serving not only to cancel a hook or slice, but to actually correct for an open club face slice or closed club face hook commonly imparted to the ball by the average golfer by urging the ball back to its proper course of flight.

Thus, there has been disclosed herein a golf ball having a new and improved surface configuration in which rough and smooth bands formed in the surface are arranged in a predetermined configuration to cancel the aerodynamic forces acting on the ball during its flight along certain axes of rotation. Preferably, the rough and smooth bands are arranged in a plurality of spaced, substantially parallel bands around the ball so as to cancel the aerodynamic forces acting on the ball along the axis of rotation normally associated with hooking or slicing of the ball during its flight.

What is claimed is:

1. A golf ball in the form of a spherical body having an outer surface, said golf ball comprising:

a plurality of parallel rough bands and a plurality of parallel alternating smooth bands disposed on said surface, said rough bands being formed to completely trip the boundary layer of air flow around said rough bands so as to cancel the forces generated by said smooth bands when said golf ball rotates about predetermined axes of rotation to thereby control the path of said golf ball during its flight.

2. The golf ball of claim 1 wherein the rough bands comprise a plurality of spaced depressions in the surface of said golf ball.

3. The golf ball of claim 2 wherein the depressions are dimples.

4. The golf ball of claim 2 wherein the plurality of bands of depressions comprises three spaced bands.

5. The golf ball of claim 4 wherein one of the spaced bands of depressions is located along the circumferential centerline of said golf ball and the other bands of depressions are equidistantly spaced on opposing sides thereof.

6. The golf ball of claim 1 wherein the area bounded by the rough bands is substantially equal to the remaining smooth area on the outer surface of said golf ball.

7. The golf ball of claim 1 wherein the area bounded by the rough bands is approximately 1.2 times the remaining smooth area on the outer surface of said golf ball.

* * * * *